United States Patent [19]

Kwan

[11] 4,079,891

[45] Mar. 21, 1978

[54] SPRAY NOZZLE

[76] Inventor: Wong Man Kwan, Evelyn Towers, 7th Fl., Block D., Cloud View Rd., North Point, Hong Kong

[21] Appl. No.: 761,325

[22] Filed: Jan. 21, 1977

Related U.S. Application Data

[63] Continuation of Ser. No. 705,448, Jul. 15, 1976, abandoned.

[30] Foreign Application Priority Data

Apr. 30, 1976 United Kingdom ..... 17853/76

[51] Int. Cl.[2] ..... B05B 1/08

[52] U.S. Cl. ..... 239/101; 239/383

[58] Field of Search ..... 239/101, 102, 380–383, 239/443–449, 389; 128/66

[56] References Cited

U.S. PATENT DOCUMENTS

| | | | |
|---|---|---|---|
| 2,878,066 | 3/1959 | Erwin | 239/383 |
| 3,762,648 | 10/1973 | Deines et al. | 239/102 X |
| 3,801,019 | 4/1974 | Trenary et al. | 239/102 X |
| 3,806,033 | 4/1974 | Daugherty | 239/389 X |
| 3,958,756 | 5/1976 | Trenary et al. | 239/102 |
| 3,960,466 | 6/1976 | Taylor | 128/66 |
| 3,967,783 | 7/1976 | Halsted et al. | 239/102 |

*Primary Examiner*—Robert W. Saifer
*Attorney, Agent, or Firm*—Perry Carvellas

[57] ABSTRACT

A spray nozzle for a showerhead is controllable to deliver a pulsating spray or a continuous spray or a variable combination of the two. Water entering at the inlet of the nozzle is adjustably divided into two flow paths one of which leads to a group of spray outlets to provide a continuous spray and the other of which leads to a further group of spray outlets via a rotary valve to provide a pulsating spray. The rotary valve comprises a cylindrical valve chamber with a rotary valve member therein, the valve member having turbine blades so that in use water entering at the valve inlet drives the valve member in rotation, and pivoted flaps mounted on the valve member which in use are centrifugally urged against the cylindrical wall of the valve chamber, there to intermittently occlude the further group of spray outlets, which open from the cylindrical wall, and to provide the pulsation in the spray, without jamming the rotary valve member.

12 Claims, 9 Drawing Figures

SPRAY NOZZLE

This is a continuation, of application Ser. No. 705,448, filed July 15, 1976, now abandoned.

FIELD OF INVENTION

This invention relates to a spray nozzle for producing a pulsating stream of water, for example for use in a home showerbath.

BACKGROUND OF THE INVENTION AND PRIOR ART

Spray nozzles for producing pulsating streams of water are known and used for example in domestic bathrooms for producing pleasant massage effects. In one prior proposal for the construction of such a spray nozzle, the pulsating effect is to be produced by the rotation of a flat apertured plate against the flat wall of a nozzle housing having discharge orifices therein, by intermittent occlusion of the orifices by the plate. With such an arrangement it is difficult to ensure freedom of the mechanism from jamming.

OBJECTS OF THE INVENTION

An object of this invention is a spray nozzle for producing a pulsating spray, in which the pulsations are produced by a rotary valve which is free from jamming in use.

Another object is a spray nozzle for producing a user-adjustable combination of a pulsating spray and a continuous (non-pulsating) spray, in which the pulsations are produced by a rotary valve which is free from jamming in use.

A further object is a spray nozzle for providing a pulsating spray, wherein the pulsations are brought about by relative sliding motion between an apertured member and a valve member for intermittently covering and uncovering the apertures, wherein the surfaces of said relatively sliding members are urged together by centrifugal force so that they can freely separate from contact one with the other when otherwise there would be a tendency to jam due to accidental circumstances such as the introduction of a particle into the fluid stream.

A further object of the invention is a spray nozzle for producing a pulsating spray by means of a valve member which is self-adjusting in the event of wear.

Still another object is a spray nozzle for producing a pulsating spray, wherein the pulsations are brought about by a valve member which retains its ability to function in the event of wear.

SUMMARY OF THE INVENTION

This invention provides a spray nozzle for providing a pulsating spray, in which the pulsations are brought about by a turbine member carrying a valve member mounted within a valve chamber and adapted to be urged by centrifugal force against a peripheral wall of said chamber and to intermittently cover an outlet port in said wall.

The invention also provides a spray nozzle comprising: a hollow housing having a fluid inlet and a plurality of fluid spray discharge orifices; flow passage means in said housing extending from said inlet to said plurality of discharge orifices; a rotary member mounted for rotation in said flow passage; a cylindrical wall portion bounding a portion of said flow passage and disposed about said rotary member; at least one outlet opening through said cylindrical wall portion and communicating with said plurality of discharge orifices; turbine means fixed to said rotary member for driving said rotary member in rotation at a rate dependent upon the rate of flow of fluid through said flow passage; valve means pivotally mounted on said rotary member and operable when said rotary member is driven in rotation to bear against said cylindrical wall portion by centrifugal force and intermittently cover and uncover said at least one outlet thereby to cause pulsations in said spray discharged from said spray discharge orifices.

The invention also provides a spray nozzle comprising a housing having a fluid inlet and a plurality of fluid discharge orifices, the housing having therein a cylindrical valve chamber having an inlet which communicates with the fluid inlet, and outlets in the cylindrical surface of the valve chamber which are in communication with the fluid discharge orifices; and mounted coaxially in the valve chamber a turbine-controlled rotary valve member adapted to be driven in rotation by fluid flowing through the nozzle, the valve member having a flap pivotally mounted thereon which is adapted in operation to trail the valve member on rotation thereof and sweep at least a portion of the cylindrical surface of the valve chamber thereby to occlude intermittently at least some of the outlets, and thereby to cause delivery of fluid by the nozzle in the form of a pulsating spray. By such use of a trailing flap it is possible to arrange a simple construction in which the means for intermittently occluding the discharge orifices is free from jamming.

A spray nozzle according to the invention can be provided with at least one further discharge orifice communicating with the fluid inlet by a flow path which bypasses the valve chamber, to provide a nonpulsating spray, and control means manually operable by a user of the nozzle to divide the fluid flow adjustably between the flow path providing the pulsating spray and said bypass flow path.

Suitably in a spray nozzle according to the invention the valve member has a pair of similar arcuate flaps pivotally mounted on the member for pivotal movement about parallel axes parallel and equidistant to the axis of rotation of the valve member and on opposite radii thereof. In one embodiment the valve member is in the form of a disk mounted for rotation in its own plane and about its center, and having turbine blades mounted on each surface, and having two pairs of similar arcuate flaps pivotally mounted thereon for movement each about one of four aces parallel and equidistant to the axis of rotation of the valve member, with the flaps of each pair being mounted one on each surface of the disk and on opposite radii thereof, whereby in operation the flaps mounted on each surface of the disk sweep adjacent cylindrical zones of the cylindrical surface of the valve chamber, and alternately occlude outlets disposed in each zone.

Other objects and features of the invention will become apparent from the following detailed description of a preferred but nonlimitative embodiment and the accompanying drawings made a part hereof and to which reference is made.

BRIEF DESCRIPTION OF THE DRAWINGS:

Referring to the drawings, FIG. 1 is a perspective view of a nozzle according to the invention, shown generally 1, in the form of a shower-head adapted to be screwed on to a stationary supply pipe, and incorporating a ball joint to enable the shower spray to be adjusted in direction by the user. The nozzle 1 includes a housing 2, and includes two groups of spray discharge orifices: a central group of orifices 3, from which a pulsating spray can be delivered in a manner to be described, and a peripheral group of orifices 4, from which a continuous, non-pulsating spray can be delivered, in a manner also to be described. The nozzle 1 incorporates control means for adjustably dividing the fluid flow between the flow path leading to orifices 3 and the flow path leading to orifices 4. The control means is manually operable by the user by a ring sleeve 5 which is fixed to the front portion of the nozzle, i.e. that surface including orifices 3, and which together with the front portion of the nozzle is rotable between stop positions relative to the housing 2.

FIG. 2 is a perspective view of another nozzle according to the invention, which is similar to the nozzle of FIG. 1 except that it is adapted for attachment to the end of a flexible pipe or hose for hand-held use. The numerals in FIG. 2 refer to similar parts as those described for FIG. 1.

FIGS. 3 and 4 together constitute an exploded and partly cut-away view of the nozzle of FIG. 1. Referring to FIGS. 3, 4 and 5, the housing 2 shown in FIG. 1 in made up of an upper hollow conical screw-threaded cap 6 threadedly engaging a main upper housing unit 7 by a screw-threaded neck 8 thereof, a lower housing unit 9 which threadedly engages unit 7, and an inner housing unit, described below. Units 6, 7 and 9 are of plastics material. Between units 6 and 7 there is held a bored metal swivel ball 10 having a screw-threaded extension for connecting the nozzle to a stationary water supply pipe. A rubber ring 11 provides sealing between ball 10 and the neck 8 of unit 7, and a further rubber ring 12 provides sealing between units 7 and 9.

Figure 1:
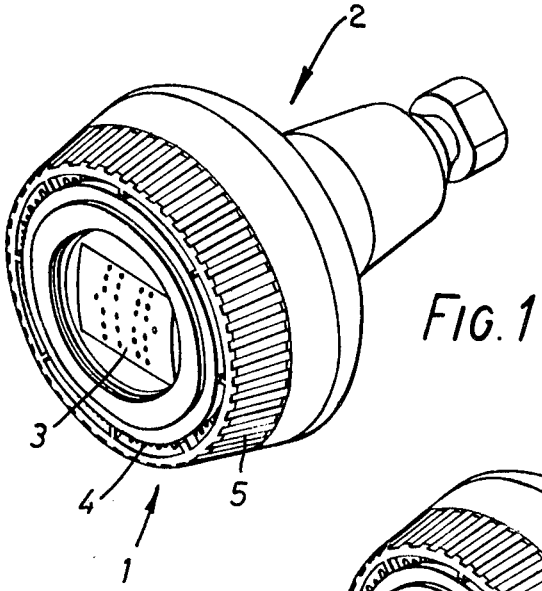
FIG. 1 is a perspective view of a spray nozzle embodying this invention, in the form of a showerhead.
Figure 2:
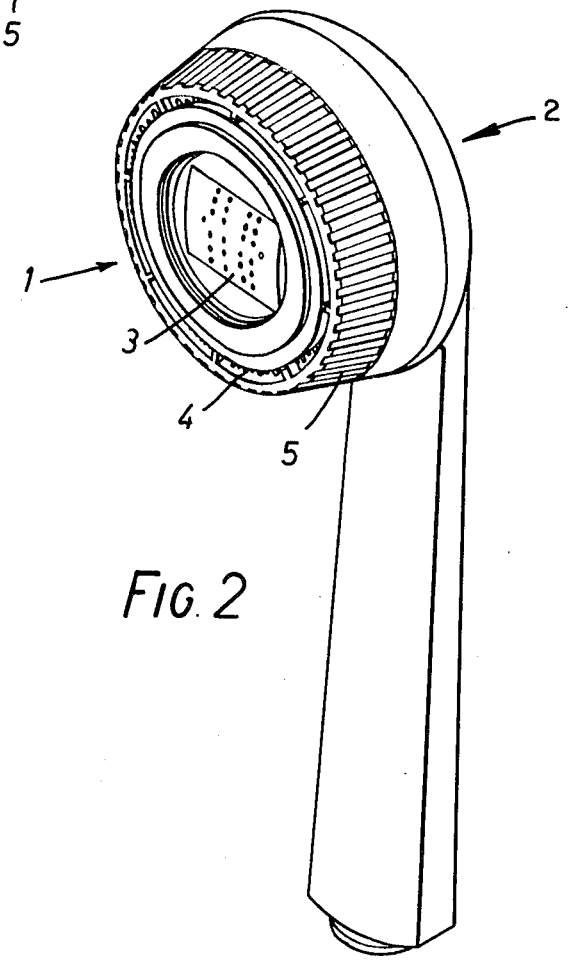
FIG. 2 is a perspective view of another spray nozzle also embodying this invention, in the form of a shower-head to be held by hand and attached to a flexible hose.
Figure 3:
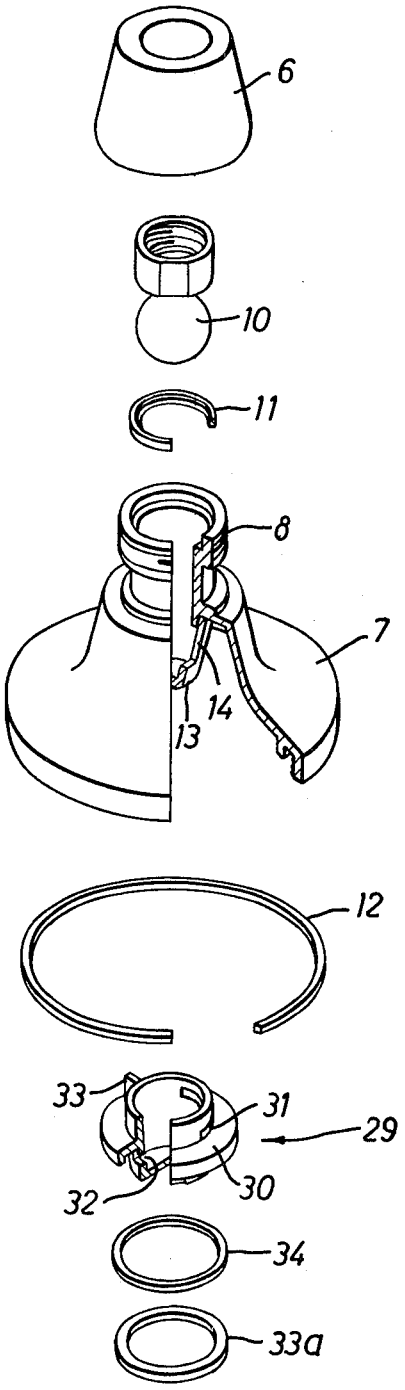
FIGS. 3 and 4 together from an exploded view of the spray nozzle of FIG. 1.

The neck 8 of unit 7 is closed by a downward truncated conical partition 13 having a closed truncated end, and which has an aperture 14 in its lateral conical surface. In use, this aperture is aligned with either or both of the inlets (to be described) of the flow paths providing respectively the pulsating and non-pulsating sprays, depending on the rotational position of the control ring sleeve 5 of FIG. 1.

Figure 4:
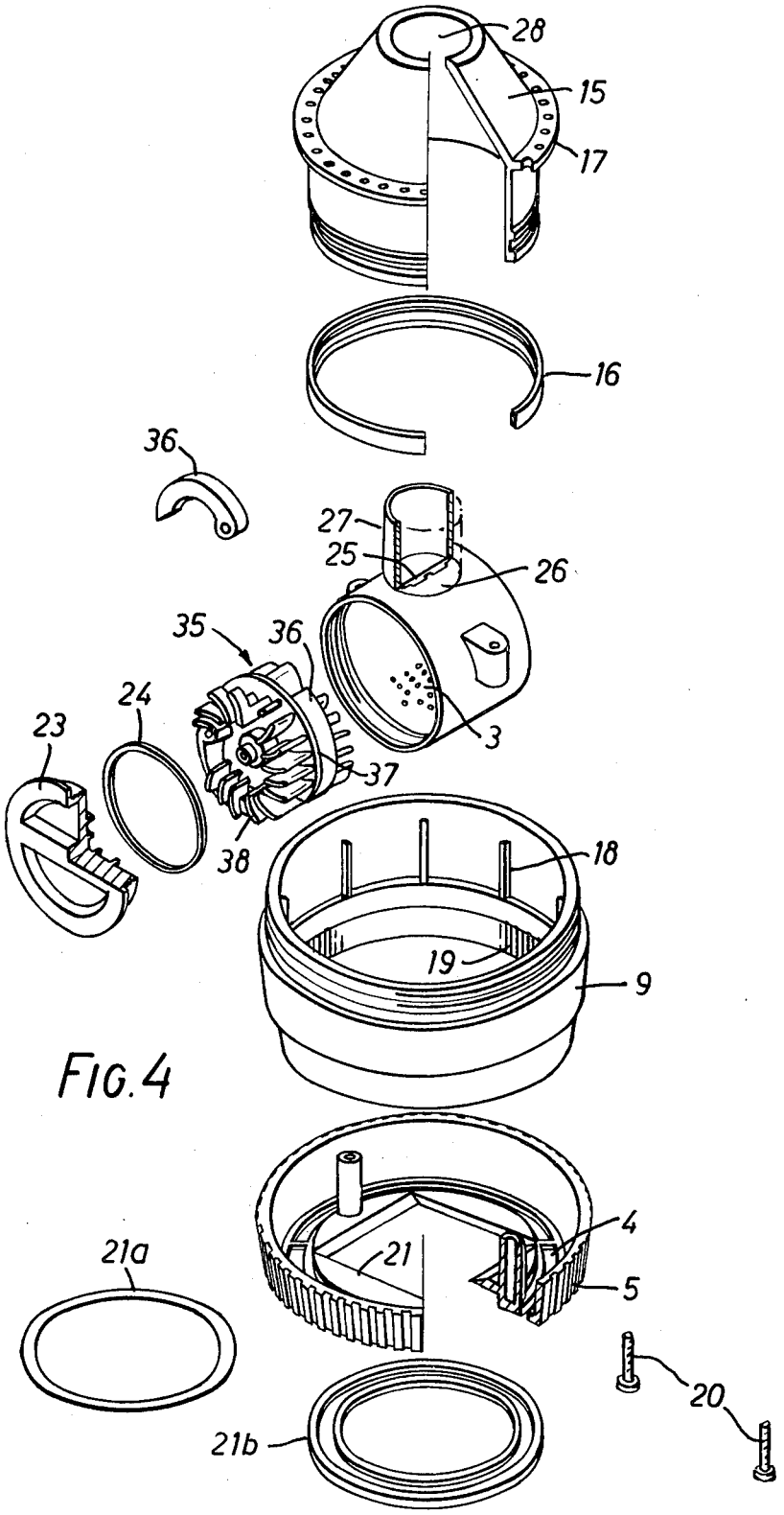

The inner housing unit 15 is a push fit by means of rubber ring 16 inside lower housing unit 9, and the two units are positively located together by the abutment of an apertured flange 17 on unit 15 with buttresses 18 inside unit 9. Units 9 and 15 together define an annular chamber forming part of a bypass flow path for providing the non-pulsating spray, and the orifices 4 are formed by the abutment of grooves 19 in the inner lower periphery of unit 9 (some only of grooves 19 are shown in FIG. 4) with the rubber ring 16 closely fitting around the lower periphery of inner housing unit 15.

Mounted within inner housing unit 15 and fixed by screws 20 to an apertured plate 21, to which are attached decorative or labelling ring 21a and cover ring 21b, and which is made integral with control ring sleeve 5, is a cylindrical valve chamber housing a rotary turbine-controlled valve, to be described in detail below.

The valve chamber is made up of a cylindrical valve chamber body 22 having one end closed by an integral wall and the other end closed by a screw-threaded cover 23, sealing being provided by a rubber sealing ring 24. Opening out of the cylindrical surface of the valve chamber body 22 are outlets which form the orifices 3. Opening into the cylindrical surface of the valve chamber body 22 on the opposite side thereof from orifices 3 is an inlet 25, formed by a pair of slots in the wall of the body 22 partly occluded by a semicircular insert 26, so that the inlet passes through the wall thickness at an oblique angle (as shown best in FIG. 5) and so that water passing through inlet 25 has a component of motion tangential to the cylindrical valve chamber body 22. Integral with valve chamber body 22 is a cylindrical neck 27 (shown partly cut away in FIG. 4) disposed about inlet 25. Neck 27 is a sliding and rotatable fit in aperture 28 of inner housing unit 15.

The top of neck 27 of valve chamber body 22 is closed by a flanged nylon cap 29 fixed and sealed to said neck 27 by a flange 30 of said cap 29. Cap 29 has an upper surface in the form of a hollow truncated cone which slidingly mates with truncated conical partition 13 of upper housing unit 7. (See particularly FIG. 5). The conical surface of cap 29 has two openings therein; a first opening 31 which opens only above flange 30, and a second opening 32 which opens only below flange 30.

Openings 31 and 32 respectively constitute the inlets of the flow paths providing the non-pulsating and the pulsating sprays. The angular sectors of the periphery of cap 29 occupied by openings 31 and 32 do not overlap.

Aperture 14 in partition 13 is sufficiently deep to uncover both that level of the conical surface of cap 29 which includes opening 31 and that level thereof which includes opening 32, and has an angular extent approximately equal to that of each of openings 31 and 32. The angular distance between openings 31 and 32 is less than the angular extent of aperture 14.

A rib 33 integral with flange 30 of cap 29 limits the rotation of cap 29 when in use by abutment against the ends of an arcuate rib 33' (FIG. 5) provided on upper housing unit 7 peripherally of conical partition 13. The openings 31 and 32 of cap 29 and the aperture 14 of partition 13 are so disposed that (according to the relative rotational position of cap 29 and partition 13 of housing 7) aperture 14 can be aligned either (a) with either one of openings 31 and 32, in which positions partition 13 occludes the respective other of openings 31 and 32, or (b) with part of each opening 31 and 32, in which position restricted flow paths are open through each of openings 31 and 32, the relative sizes of said restricted flow paths being continuously variable according to the relative rotational position of cap 29 and partition 13 of housing 7.

In the assembled nozzle, neck 27 of valve chamber body 22 projects through aperture 28 in inner housing unit 15, and cap 29 is maintained in abutment with partition 13 of housing unit 7 by spacing and sealing rings 33*a* and 34 disposed about neck 27, and between the neck of unit 15 and flange 30 of cap 29.

Mounted for rotation within the rotary valve chamber body 22 is a rotary valve generally designated 35. Rotary valve 35 has four arcuate flaps pivotally mounted thereon, of which one is shown at 36 (FIG. 4). Each arcuate flap 36 has an arcuate part-cylindrical surface which is substantially complementary with the inner cylindrical surface of the cylindrical valve chamber body 22.

Figure 6:
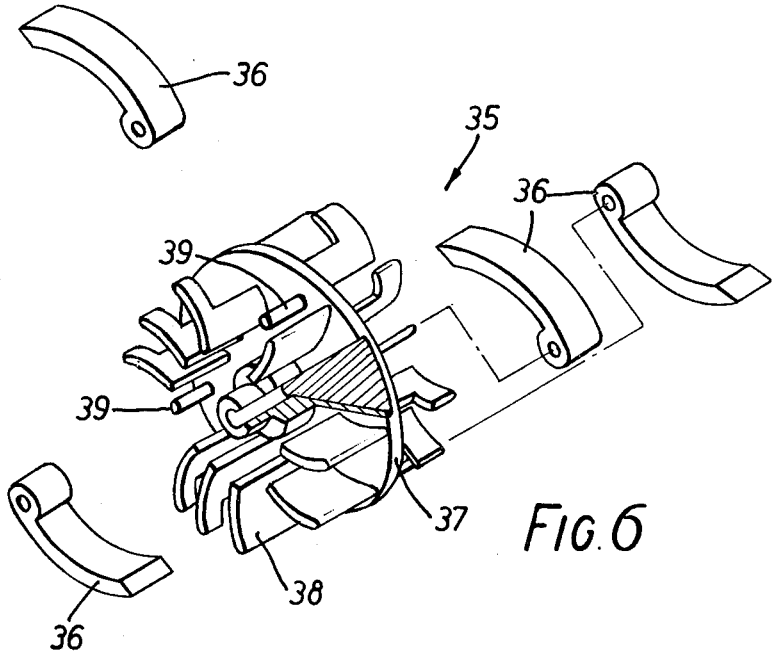
FIG. 6 is an exploded perspective view of the rotary valve member of the nozzle of FIGS. 3, 4 and 5.

FIG. 6 is an enlarged perspective view, partly exploded and cut away, of rotary valve 35. Rotary valve 35 comprises a disc or plate 37, which has bushings centrally disposed on each side, and which fits with clearance in the cylindrical valve chamber. Plate 37 is mounted for rotation within said chamber about the axis of the chamber and also about the center and in the plane of said plate 37, by means of bushings disposed centrally on the inner side of cover 23, and on the inside of the opposite circular end face of cylindrical valve chamber body 22, which bushings telescopically overlap said bushings of said plate 37. Plate 37 has on each surface thereof a plurality of turbine blades 38, and two pins 39 adjacent the periphery of plate 37 for pivotally and releasably mounting the arcuate flaps 36. Some of the turbine blades 38 are cut away so that they can accommodate the arcuate flaps within the periphery of plate 37 and retain the flaps axially on their mounting pins 39. Pins 39, about which said arcuate flaps 36 are pivotable, are parallel and equidistant to the axis of rotation of the rotary valve 35, and arranged in two pairs, with one pin of each pair on each surface of plate 37, and on opposite radii thereof. The two pins 39 on each surface of plate 37 are so disposed and the arcuate flaps mounted thereon are of such a length that said flaps occupy adjacent arcs of the periphery of plate 37.

Figure 5:
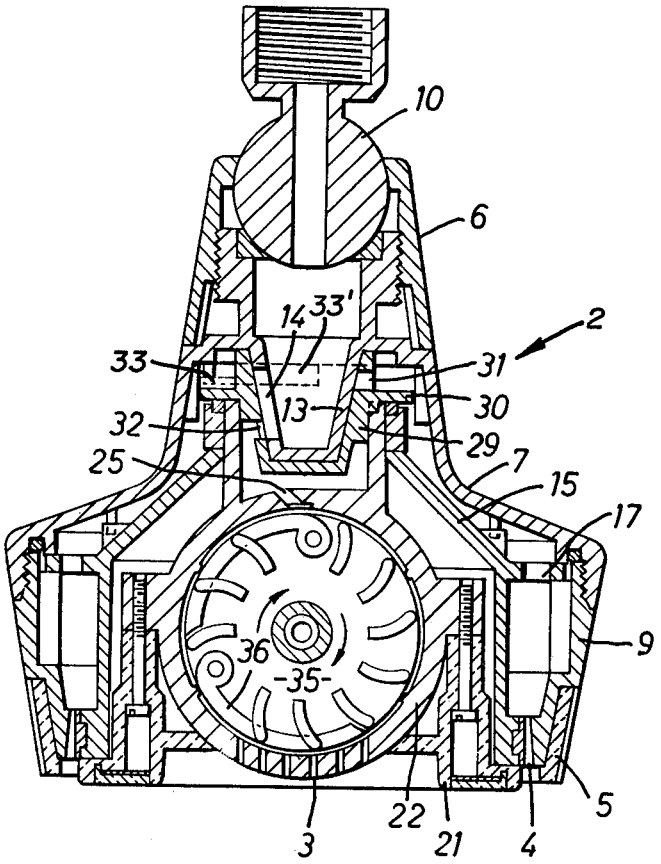
FIG. 5 is a cross-section of the nozzle of FIG. 1, including the axis in the plane of section.

Rotary valve 35 is mounted in the valve chamber in such a direction that water entering the chamber through inlet 25 thereof drives valve 35 in rotation by impinging on the turbine blades 38, and so that arcuate flaps 36 trail the valve member, i.e. in the direction shown by the arrow in FIG. 5, and trail behind their pivot mountings, being urged centrifugally against the cylindrical periphery of the chamber. The outlets in the cylindrical inner surface of the valve chamber body 22, in communication with respective orifices 3 on the outside surface thereof, are arranged in two groups, each of which groups is disposed on said cylindrical surface so that it is swept by the arcuate flaps 36 on one of said surfaces of plate 37 when the valve 35 is driven in rotation.

Figure 7A:
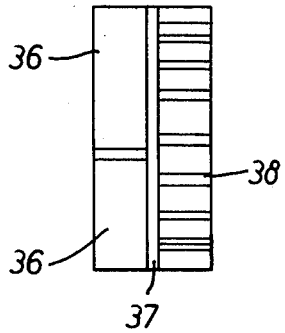
FIGS. 7A, 7B and 7C are respectively schematic view of the valve member of FIG. 6, shown edgewise on, from one side, and from the other side.
Figure 7B:
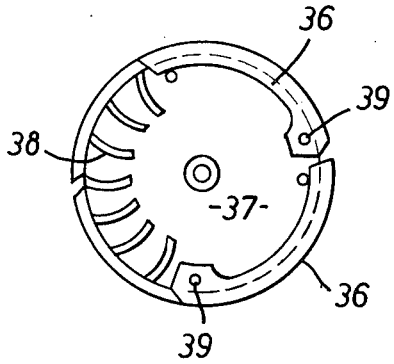
Figure 7C:
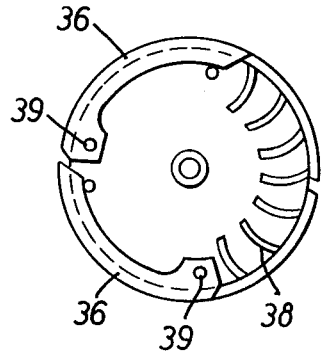

FIGS. 7A, 7B and 7C, schematic views of rotary valve 35 respectively seen edgewise on, from one side, and from the other side, show that the arc of the valve periphery occupied by arcuate flaps 36 on one face of the valve is diametrically opposite the arc which is so occupied on the other face of the valve. The valve is made of nylon, and many of the other parts of the nozzle described are also of nylon, or other plastics material, ABS or acrylic, except where otherwise above stated.

The operation of the nozzle is as follows. The nozzle is set to deliver a pulsating spray from orifices 3, and no non-pulsating spray from orifices 4, by rotating ring sleeve 5 relative to housing 2. Ring sleeve 5 is fixed to plate 21 and thence to valve chamber body 22, neck 27, and cap 29, and housing 2 is fixed to partition 13, and they are relatively rotated until aperture 14 in partition 13 is aligned with opening 32 in cap 29, and partition 13 occludes opening 31 in cap 29. A supply of water is connected via the screw-threaded extension of swivel-ball 10, and water from the supply passes through neck 8 of housing unit 7, to conical partition 13, through aperture 14 and opening 32, through neck 27 and through inlet 25, into the cylindrical valve chamber 22. The water passing through inlet 25 into the valve chamber drives the rotary valve 35 in rotation in the direction of the arrow shown in FIG. 5 by impinging on blades 38. The rotation of the valve causes the arcuate flaps 36 to trail around the inner cylindrical surface of the valve chamber and intermittently occlude the flow path through orifices 3. In this way, a pulsating water spray is delivered from orifices 3, with pulses of spray emerging alternately from each of the two groups of orifices comprised in orifices 3 as each said group is intermittently uncovered with the passage of the arcuate flaps mounted on the respective face of plate 37.

The operation of the nozzle is adjustable by rotation of ring sleeve 5 and the parts fixed thereto, in order to bring aperture 14 into alignment with opening 31. In this position, the water instead of or in addition to flowing through opening 32 as described above, flows through opening 31 and thence into the annular chamber defined by inner housing unit 15 and lower housing unit 9, from which it passes out of the nozzle by orifices 4, bypassing the valve chamber and providing a continuous spray. As described above, the rotational position of the ring sleeve 5 determines the proportion of the flow directed through the valve chamber, and hence the relative strength and frequency of the pulsating effect.

The stop positions of the control ring sleeve 5 and the openings 31 and 32 in cap 29 and aperture 14 in conical partition 13 are so arranged that the control ring sleeve 5 is rotatable not only between a position corresponding to the delivery of a completely non-pulsating spray and a position corresponding to a completely pulsating spray, and positions therebetween (as already described), but also to positions in which opening 32 (inlet for the flow path providing the non-pulsating spray) is completely occluded by partition 13 and opening 31 (inlet for the flow path providing the pulsating spray) is progressively restricted. In such latter positions of sleeve 5 the flow of water is directed entirely through orifices 3 but is adjustably restricted in volume. In this way the strength of the spray can be varied and also the frequency of pulsation (which is proportional to the flow through orifices 3) can be reduced.

With the arrangement of the nozzle described above, the arcuate flaps 36 are urged against the internal cylindrical surface of the valve chamber by centrifugal force with rotation of the valve, thereby efficiently occluding the orifices 3, but they do not jam because they are freely pivotable and able to move freely to a position within the periphery of plate 37. When they become worn they are easily replaceable on dismantling the nozzle and unscrewing the cover 23 of the valve chamber to remove the valve.

I claim:

1. In a spray nozzle comprising:

a hollow housing having a fluid inlet and a first and second plurality of fluid spray discharge orifices;

means in said housing defining first and second flow passages in said housing extending from said inlet respectively to said first and second plurality of discharge orifices;

control means for adjustably controlling flow from said inlet to said first and second plurality of discharge orifices in controllable proportion;

the improvement comprising a cylindrical valve chamber in series with said first flow passage;

a cylindrical wall forming part of said cylindrical chamber;

at least one outlet opening through said cylindrical wall and communicating with said first plurality of discharge orifices;

a rotary member mounted for rotation in said cylindrical valve chamber;

turbine means fixed to said rotary member for driving said member in rotation in said chamber at a rate dependent on the rate of flow of fluid through said chamber;

and at least one flap pivotally mounted on said rotary member and operable when said rotary member is driven in rotation to bear against said cylindrical wall by centrifugal force and intermittently cover and uncover said at least one outlet, thereby to cause pulsations in said spray discharged from said first plurality of discharge orifices;

said second flow passage bypassing said cylindrical valve chamber whereby fluid flowing through said second flow passage is discharged through said second plurality of orifices as a non-pulsating spray.

2. A spray nozzle according to claim 1, wherein said rotary member is in the form of a disk mounted for rotation in said cylindrical valve chamber about its own centre and in its own plane and about the axis of said chamber, and said turbine means comprises turbine blades mounted on each surface of said disk; and wherein two pairs of arcuate flaps are pivotally mounted on said disk each for movement about one of four axes parallel and equidistant to said axis of rotation of said disk, with one flap of each pair being mounted on each surface of said disk and on opposite radii thereof, whereby in operation the flaps mounted on each surface of said disk sweep adjacent cylindrical bands of said cylindrical wall of said chamber alternately and at least one of said outlet opens through said cylindrical wall in each said band.

3. A spray nozzle comprising: a hollow housing having a fluid inlet and a plurality of fluid spray discharge orifices; flow passage means in said housing extending from said inlet to said plurality of discharge orifices; a rotary member mounted for rotation in said flow passage; a cylindrical wall portion bounding a portion of said flow passage and disposed about said rotary member; at least one outlet opening through said cylindrical wall portion and communicating with said plurality of discharge orifices; turbine means fixed to said rotary member for driving said rotary member in rotation at a rate dependent on the rate of flow of fluid through said flow passage; valve means pivotally mounted on said rotary member and operable when said rotary member is driven in rotation to bear against said cylindrical wall portion by centrifugal force and intermittently cover and uncover said at least one outlet thereby to cause pulsations in said spray discharged from said spray discharge orifices.

4. A spray nozzle comprising a housing having a fluid inlet and a plurality of fluid discharge orifices, the housing having therein a cylindrical valve chamber having an inlet which communicates with the fluid inlet, and outlets in the cylindrical surfaces of the valve chamber which are in communication with the fluid discharge orifices; and mounted coaxially in the valve chamber a turbine-controlled rotary valve member adapted to be driven in rotation by fluid flowing through the nozzle, the valve member having a flap pivotally mounted thereon which is adapted in operation to trail the valve member on rotation thereof and sweep at least a portion of the cylindrical surface of the valve chamber, thereby to occlude intermittently at least some of the outlets, and thereby to cause delivery of fluid by the nozzle in the form of a pulsating spray.

5. A spray nozzle according to claim 4, comprising at least one further discharge orifice communicating with the fluid inlet by a flow path which bypasses the valve chamber, to provide a non-pulsating spray, and control means manually operable by a user of the nozzle to divide the fluid flow adjustably between the flow path providing the pulsating spray and said bypass flow path.

6. A spray nozzle according to claim 4, wherein the valve member has a pair of similar arcuate flaps pivotally mounted on the member for pivotal movement about parallel axes parallel and equidistant to the axis of rotation of the valve member and on opposite radii thereof.

7. A spray nozzle according to claim 6, wherein the valve member is in the form of a disk mounted for rotation in its own plane and about its center, and having turbine blades mounted on each surface, and having two pairs of similar arcuate flaps pivotally mounted thereon for movement each about one of four axes parallel and equidistant to the axis of rotation of the valve member, with the flaps of each pair being mounted one on each surface of the disk and on opposite radii thereof, whereby in operation the flaps mounted on each surface of the disk sweep adjacent cylindrical zones of the cylindrical surface of the valve chamber, and alternately occlude outlets disposed in each zone.

8. A showerhead or spray nozzle for providing a pulsating spray, comprising a turbine member carrying a valve member which is movably mounted relative to said turbine member to be urged by centrifugal force against a peripheral wall and to intermittently cover an outlet port in said wall.

9. In a spray nozzle comprising:

a hollow housing having a fluid inlet and a first and second plurality of fluid spray discharge orifices;

means in said housing defining first and second flow passages in said housing extending from said inlet respectively to said first and second plurality of discharge orifices;

control means for adjustably controlling flow from said inlet to said first and second plurality of discharge orifices in controllable proportion;

the improvement comprising a cylindrical valve chamber in fluid communication with said first flow passage;

a cylindrical wall forming part of said cylindrical chamber;

a plurality of outlet openings through said cylindrical wall defining said first plurality of discharge orifices;

a rotary member mounted for rotation in said cylindrical valve chamber;

turbine means fixed to said rotary member for driving said member in rotation in said chamber at a rate dependent on the rate of flow of fluid through said chamber;

and at least one flap pivotally mounted on said rotary member and operable when said rotary member is driven in rotation to bear against said cylindrical wall by centrifugal force and intermittently cover and uncover at least one of said outlet openings, thereby to cause pulsations in said spray discharged from said first plurality of discharge orifices;

said second flow passage bypassing said cylindrical valve chamber whereby fluid flowing through said second flow passage is discharged through said second plurality of orifices as a non-pulsating spray.

10. A spray nozzle according to claim 9, wherein said rotary member is in the form of a disk mounted for rotation in said cylindrical valve chamber about its own centre and in its own plane and about the axis of said chamber; and said turbine means comprises turbine blades mounted on each surface of said disk; and wherein two pairs of arcuate flaps are pivotally mounted on said disk each for movement about one of four axes parallel and equi-distant to said axis of rotation of said disk, with one flap of each pair being mounted on each surface of said disk and on opposite radii thereof, whereby in operation the flaps mounted on each surface of said disk sweep adjacent cylindrical bands of said cylindrical wall of said chamber alternately and at least one of said outlet opens through said cylindrical wall in each said band.

11. A spray nozzle comprising: a hollow housing having a fluid inlet and a plurality of fluid spray discharge orifices; flow passage means in said housing extending from said inlet to said plurality of discharge orifices; a rotary member mounted for rotation in said flow passage; a cylindrical wall portion bounding a portion of said flow passage and disposed about said rotary member; at least one outlet opening through said cylindrical wall portion defining at least one of said discharge orifices; turbine means fixed to said rotary member for driving said rotary member in rotation at a rate dependent on the rate of flow of fluid through said flow passage; valve means pivotally mounted on said rotary member and operable when said rotary member is driven in rotation to bear against said cylindrical wall portion by centrifugal force and intermittently cover and uncover at least one of said outlet openings thereby to cause pulsations in said spray discharged from said spray discharge orifices.

12. A spray nozzle comprising a housing having a fluid inlet and a plurality of fluid discharge orifices, the housing having therein a cylindrical valve chamber having at inlet which communicates with the fluid inlet, and outlets in the cylindrical surfaces of the valve chamber which define said fluid discharge orifices; and mounted coaxially in the valve chamber a turbine-controlled rotary valve member adapted to be driven in rotation by fluid flowing through the nozzle, the valve member having a flap pivotally mounted thereon which is adapted in operation to trail the valve member on rotation thereof and sweep at least a portion of the cylindrical surface of the valve chamber, thereby to occlude intermittently at least some of the outlets, and thereby to cause delivery of fluid by the nozzle in the form of a pulsating spray.

* * * * *